US007938952B2

(12) United States Patent
Colyar et al.

(10) Patent No.: US 7,938,952 B2
(45) Date of Patent: May 10, 2011

(54) PROCESS FOR MULTISTAGE RESIDUE HYDROCONVERSION INTEGRATED WITH STRAIGHT-RUN AND CONVERSION GASOILS HYDROCONVERSION STEPS

(75) Inventors: James J. Colyar, Newtown, PA (US); John Duddy, Langhorne, PA (US)

(73) Assignee: Institute Francais du Petrole, Rueil-Malmaison (FR)

( * ) Notice: Subject to any disclaimer, the term of this patent is extended or adjusted under 35 U.S.C. 154(b) by 420 days.

(21) Appl. No.: 12/154,010

(22) Filed: May 20, 2008

(65) Prior Publication Data

US 2009/0288986 A1 Nov. 26, 2009

(51) Int. Cl.
*C10G 65/02* (2006.01)

(52) U.S. Cl. ..... 208/58; 208/57; 208/49; 208/46

(58) Field of Classification Search ..... 208/58
See application file for complete search history.

(56) References Cited

U.S. PATENT DOCUMENTS

| | | | | |
|---|---|---|---|---|
| 4,588,709 | A | 5/1986 | Morales | |
| 4,776,945 | A | 10/1988 | Washecheck et al. | |
| 4,810,361 | A | 3/1989 | Absil | |
| 4,810,363 | A | 3/1989 | Van Den Berg | |
| 5,198,100 | A | 3/1993 | Aldridge et al. | |
| 5,225,383 | A | 7/1993 | Kukes | |
| 5,961,815 | A * | 10/1999 | Hickey et al. | 208/108 |
| 6,547,956 | B1 * | 4/2003 | Mukherjee et al. | 208/58 |

FOREIGN PATENT DOCUMENTS

WO WO 0198436 A1 * 12/2001

* cited by examiner

*Primary Examiner* — Glenn A Caldarola
*Assistant Examiner* — Michelle L Stein
(74) *Attorney, Agent, or Firm* — John F. Ritter

(57) ABSTRACT

This invention relates to a novel integrated hydroconversion process for converting heavy atmospheric or vacuum residue feeds and also converting and reducing impurities in the vacuum gas oil liquid product. This is accomplished by utilizing two residue hydroconversion reaction stages, two vapor-liquid separators, and at least two additional distillate ebullated-bed hydrocracking/hydrotreating reaction stages to provide a high conversion rate of the residue feedstocks.

12 Claims, 1 Drawing Sheet

PROCESS FOR MULTISTAGE RESIDUE HYDROCONVERSION INTEGRATED WITH STRAIGHT-RUN AND CONVERSION GASOILS HYDROCONVERSION STEPS

FIELD OF THE INVENTION

This invention relates to a novel integrated hydroconversion process for converting heavy hydrocarbon feeds containing vacuum residue and converting and reducing impurities in the straight run and conversion product vacuum gas oil liquids. This is accomplished by utilizing two residue ebullated-bed hydroconversion reaction stages, two vapor-liquid separators, and at least two additional distillate ebullated-bed hydrocracking/hydrotreating reaction stages.

In a two-stage residue hydroconversion reactor system, the atmospheric or vacuum residue feed and hydrogen react with a catalyst in the first residue hydroconversion stage to produce lighter hydrocarbons. The stage one effluent is thereafter separated in an interstage separator which separates the effluent into a liquid phase and a vapor phase.

The liquid phase from this interstage separator is then fed to the second residue hydroconversion reaction stage for additional conversion and impurity reduction. The resulting mixed-phase effluent product from this second stage is sent to a second high-pressure separator with the liquid product sent to product separation.

The overhead vapor from the first stage (interstage separator) and from the second vapor liquid separator contain significant unreacted hydrogen and are thereafter sent to separate distillate ebullated-bed reactors for conversion and hydrotreatment of the diesel and vacuum gas oils contained in these streams. These downstream ebullated-bed hydrogenating/hydrotreating reactors are called distillate ebullated-bed reactors to distinguish them from the upstream system. Additional feedstocks to these distillate ebullated-bed reactors could include straight run vacuum gas oil, cracked material from other processing units, and recovered diesel and VGO from the second-stage residue ebullated-bed hydrocracking product.

BACKGROUND OF THE INVENTION

Hydrocarbon compounds are useful for a number of purposes. In particular, hydrocarbon compounds are useful, inter alia, as fuels, solvents, degreasers, cleaning agents, and polymer precursors. The most important source of hydrocarbon compounds is petroleum crude oil. Refining of crude oil into separate hydrocarbon compound fractions is a well-known processing technique that can be accomplished by a variety of different methods.

Crude oils range widely in their composition and physical and chemical properties. Crude oil with a similar mix of physical and chemical characteristics, usually produced from a given reservoir, field or sometimes even a region, constitutes a crude oil "stream." Most simply, crude oils are classified by their density and sulfur content. Less dense (or "lighter") crudes generally have a higher share of light hydrocarbons—higher value products—that can be recovered with simple distillation. The denser ("heavier") crude oils produce a greater share of lower-valued products with simple distillation and require additional processing to produce the desired range of products. Heavy crudes are also characterized by a relatively high viscosity and low API gravity (generally lower than 25°) and high percentage of high boiling components (>975° F.).

Additionally, some crude oils also have a higher sulfur content, an undesirable characteristic with respect to both processing and product quality. The quality of the crude oil dictates the level of processing and re-processing necessary to achieve the optimal mix of product output.

In the last two decades, the need to process heavier crude oils has increased. Refined petroleum products generally have higher average hydrogen to carbon ratios on a molecular basis. Therefore, the upgrading of a petroleum refinery hydrocarbon fraction is classified into one of two categories: hydrogen addition and carbon rejection. Hydrogen addition is performed by processes such as hydrotreating and hydrocracking. Carbon rejection processes typically produce a stream of rejected high carbon material which may be a liquid or a solid; e.g., coke.

To facilitate processing, heavy crudes or their fractions are generally subjected to thermal cracking or hydrocracking to convert the higher boiling fractions to lower boiling fractions, followed by hydrotreating to remove heteroatoms such as sulfur, nitrogen, oxygen and metallic impurities.

Further information on hydrotreating catalysts, techniques and operating conditions for residue feeds may be obtained by reference to U.S. Pat. Nos. 5,198,100; 4,810,361; 4,810,363; 4,588,709; 4,776,945 and 5,225,383 which are incorporated herein for this teaching.

Crude petroleums oils with greater amounts of impurities including asphaltenes, metals, organic sulfur and organic nitrogen require more severe processing to remove them. Generally speaking, the more severe the conditions required to treat a given feedstock (e.g. higher temperature and pressures), the greater the cost to build and operate the overall plant.

Worldwide, fixed-bed reactors are utilized considerably more than ebullated-bed reactors. The fixed-bed system is used for lighter, higher quality feedstocks and is a well understood system. Fixed-bed systems are used mostly for naphtha, mid-distillate, atmospheric and vacuum gas-oils, and atmospheric residua treatment.

However, as the feedstock becomes heavier, has a greater level of impurities, or requires more severe conversion levels, the fixed-bed system becomes less effective and less efficient. In these cases, the ebullated-bed reactor systems are better suited for residue processing.

In general, ebullated-bed reactors are utilized to process heavy crude oil feed streams, particularly those feeds with high metals content and high Conradson carbon residue ("CCR"). The ebullated-bed process comprises the passing of concurrently flowing streams of liquids, or slurries of liquids and solids, and gas through a vertically elongated fluidized catalyst bed. The catalyst is fluidized and completely mixed by the upwardly flowing liquid streams. The ebullated-bed process has commercial application in the conversion and upgrading of heavy liquid hydrocarbons and converting coal to synthetic oils.

The ebullated-bed reactor and related process well-known to those skilled in the art and is generally described in U.S. Pat. No. 25,770 to Johanson, which is incorporated herein by reference. Briefly, a mixture of hydrocarbon liquid and hydrogen is passed upwardly through a bed of catalyst particles at a rate such that the particles are forced into random motion as the liquid and gas pass upwardly through the bed. The catalyst bed motion is controlled by a recycle liquid flow so that at steady state, the bulk of the catalyst does not rise above a definable level in the reactor. Vapors, along with the liquid which is being hydrogenated, pass through the upper level of catalyst particles into a substantially catalyst free zone and are removed from the upper portion of the reactor.

Ebullated-bed reactors are generally operated at relatively high temperatures and pressures in order to process these heavy feedstocks. Since such operating parameters substantially increase the cost of designing and constructing the reactors, it would therefore be advantageous to have a system wherein the overall design and manufacturing costs were optimized for specific feedstocks or feedstock components. This optimization would result in a lower initial investment and lower annual operating costs.

Typically, multi-stage ebullated-bed overhead streams processing atmospheric or vacuum residues are combined and sent to additional separation steps including the recovery of light liquids and preparation of a recycle gas which contains any unreacted hydrogen. However, this is not thermally efficient since it requires the streams to be depressurized, cooled down and fractionated, resulting in energy loss.

Alternatively, the combined separator overheads containing significant unreacted hydrogen could be sent to a fixed-bed or ebullated-bed hydrotreater or hydrocracker to hydroprocess the liquids contained in the high pressure vapor plus any external or recycle distillates or VGO. However, even a small amount of entrained vacuum residue and/or fines would render a fixed-bed incapable of processing this feed. Moreover, if the feedrate is high, and if there are high amounts of external streams also requiring hydroprocessing, a single ebullated-bed reactor may not have sufficient capacity to hydroprocess the streams.

It would be therefore desirable to have a configuration which effectively integrates the petroleum atmospheric or vacuum residue hydrocracking and the vacuum gas oil hydrotreating/hydrocracking. Moreover, it would be highly desirable to have a configuration that overcomes the flowrate limitations of conventional designs described above. The present invention overcomes such limitations.

The term "vacuum gas oil" (VGO) as used herein is to be taken as a reference to hydrocarbons or hydrocarbon mixtures which are isolated as distillate streams obtained during the conventional vacuum distillation of a refinery stream, a petroleum stream or a crude oil stream.

The term "naphtha" as used herein is a reference to hydrocarbons or hydrocarbon mixtures having a boiling point or boiling point range substantially corresponding to that of the naphtha (sometimes referred to as the gasoline) fractions obtained during the conventional atmospheric distillation of crude oil feed. In such a distillation, the following fractions are isolated from the crude oil feed: one or more naphtha fractions boiling in the range of from 90 to 430° F. one or more kerosene fractions boiling in the range of from 390 to 570° F. and one or more diesel fractions boiling in the range of from 350 to 700° F. The boiling point ranges of the various product fractions isolated in any particular refinery will vary with such factors as the characteristics of the crude oil source, refinery local markets, product prices, etc. Reference is made to ASTM standards D-975 and D-3699-83 for further details on kerosene and diesel fuel properties.

The term "hydrotreating" as used herein refers to a catalytic process wherein a suitable hydrocarbon-based feed stream is contacted with a hydrogen-containing treat gas in the presence of suitable catalysts for removing heteroatoms, such as sulfur and nitrogen and for some hydrogenation of aromatics.

The term "desulfurization" as used herein refers to a catalytic process wherein a suitable hydrocarbon-based feed stream is contacted with a hydrogen-containing treat gas in the presence of suitable catalysts for removing heteroatoms such as sulfur atoms from the feed stream.

The term "hydrocracking" as used herein refers to a catalytic process wherein a suitable hydrocarbon-based feed stream is contacted with a hydrogen-containing treat gas in the presence of suitable catalysts for reducing the boiling point and the average molecular weight of the feed stream.

SUMMARY OF THE INVENTION

The object of this invention is to provide a new integrated petroleum residue hydrocracking and distillate vacuum gas oil hydrotreating/hydrocracking process configuration.

It is another object of this invention to provide a method for the processing of individual stage overhead vapors from the residue ebullated-bed hydrocracking reactors in separate distillate ebullated-bed reactors to overcome processing limitations at high feedstock throughput rates for conventional designs.

It is a further object of the invention to provide a unique integrated design which utilizes distillate ebullated-bed reactors for diesel and vacuum gas oil processing so as to alleviate issues relating to solids and vacuum residue carryover, which would normally be of concern for fixed-bed reactors.

It is yet a further object of the invention to provide the use of separate distillate ebullated-bed reactors to allow for additional processing capacity for streams other than those from the residue conversion step including straight run, cracked and FCC products.

A novel feature of the invention is the integration of the hydroconversion of heavy atmospheric or vacuum residue product with vacuum gas oil hydrotreating/hydrocracking in an ebullated-bed reactor. In the unique configuration of this invention, the heavy residue from the crude fractionator is sent to a multiple stage atmospheric or vacuum residue conversion process with an interstage separator. The liquid product from the interstage separator between the vacuum residue hydroconversion units is sent to the second-stage vacuum residue ebullated-bed hydroconversion unit for additional processing. The vapor products from the interstage separator and the vapor product from the second stage ebullated-bed hot separator are sent to separate distillate ebullated-bed reactors.

The straight run vacuum gas oil ("VGO") products (e.g. those typically boiling in the 650-975° F. range) are sent to a feed drum along with additional VGO feeds, which are pumped to pressure and thereafter equally routed to a separate distillate ebullated-bed unit for processing. Although there are many other possible configurations, the one described below has two residue ebullated-bed units operating in series for processing the heavy residue and two distillate ebullated-bed units operating in parallel for the processing of the separator overhead vapors and external feeds consisting of primarily VGO from multiple sources.

More particularly, the present invention describes a process for the integration and treatment of multiple types and sources of hydrocarbons comprising:

A process for the treatment of heavy hydrocarbon feedstream(s) containing vacuum residue comprising:

a) passing said hydrocarbon feedstream into a first residue hydroconversion reaction stage ebullated-bed reactor to provide an effluent, said hydrocarbon feedstream boiling above 650° F. and having 50%-100% wt material boiling above 975° F.; and b) separating said effluent from the first reaction stage ebullated-bed reactor in an interstage separator, where said effluent is separated into a vapor phase and a liquid phase; and c) feeding the liquid phase from said interstage separator to a second residue hydroconversion reaction stage ebullated-bed reactor for additional conversion and impurity reduction; and d) feeding the vapor phase from said interstage separator to a first downstream distillate ebullated-bed reactor for additional hydroconversion and hydrotreatment; and e) processing the effluent from said second residue hydroconversion reaction stage ebullated-bed reactor to a hot, high-pressure separator to provide a liquid phase and a vapor phase from said high-pressure separator; and f) feeding said vapor phase from said high-pressure separator to a second downstream distillate ebullated-bed reactor for additional conversion and impurity reduction; and g) fractionating the liquid phase from said hot, high-pressure separator to produce naphtha, diesel, VGO, and unconverted residue, and h) recovering effluents from first and second distillate ebullated-bed reactors.

Preferably, the hydrocarbon feedstream contains greater than 60% wt material boiling above 975° F., more preferably greater than 70% or than 80% or than 90%.

In a preferred embodiment, at least one separate source of materials boiling in the vacuum gas oil range (650-975° F.) which could contain materials boiling in the diesel range (350-650° F.) is also fed to at least one downstream distillate ebullated-bed reactor along with the vapor phase from said interstage separator or hot high-pressure separator of step f).

Generally, the effluent from the first downstream distillate ebullated-bed reactor and the effluent from the second downstream distillate ebullated-bed are combined and thereafter sent for hydrotreatment and product separation.

Advantageously, the VGO stream of step g) is thereafter recycled back to the first and/or second distillate ebullated-bed reactors.

In the process according to the invention, the overall conversion percentage of the hydrocarbon feedstream is preferably greater than 50% wt, and more preferably greater than 80%, or than 90% or than 95%.

DETAILED DESCRIPTION OF THE INVENTION

Figure 1:
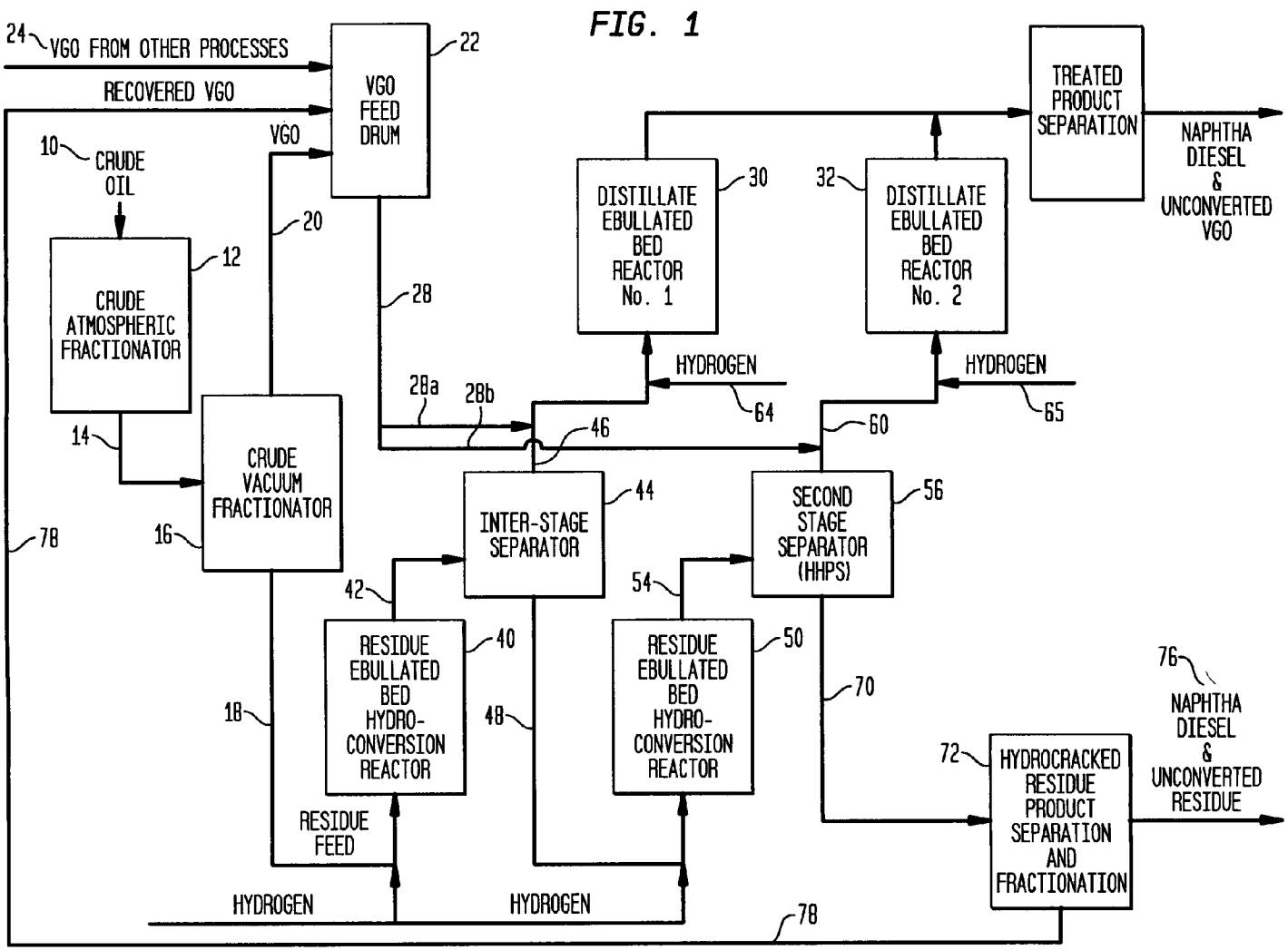
FIG. 1 is a schematic flowsheet of the integrated process for the hydroconversion of heavy residue and VGO hydrocracking/hydrotreatment.

Crude oil (10) is first processed through a crude atmospheric fractionator (12) to create a bottoms stream (14) boiling above 650° F. and a lighter stream (not shown).

The bottoms stream (14) from the crude atmospheric fractionator (12) is thereafter sent to a vacuum fractionator (16) to create a residue feed stream (18) boiling above 975° F. and a vacuum gas oil (VGO) stream (20) boiling between 650° F. and 975° F. The VGO stream (20) is fed to a VGO feed drum (22) along with recovered VGO from downstream separation (78) and VGO from other processes (24) to create a VGO feed drum stream (28) and thereafter sent to a first (30) and second (32) distillate ebullated-bed reactors as hereinafter described. These additional VGO streams boil in the heavy diesel and vacuum gas oil range (650-1000° F.). Specifically, these streams can include, but are not limited to, external feeds from straight-run atmospheric or vacuum distillate towers, coker derived liquids, solvent deasphalting DAO, and liquid products recycled from the residue conversion unit.

The vacuum residue feed stream (18) is thereafter combined with a hydrogen stream and sent to a first residue ebullated-bed reactor for hydroconversion.

The effluent from the first residue ebullated-bed reactor (42) is thereafter sent to an interstage separator (44) and separated into a vapor phase (46) and a liquid phase (48). The interstage separator (44) is necessitated by the high vacuum residue feedrate as well as the need to minimize the initial investment needed for the plant design.

The vapor phase (46) will contain naphtha, diesel, some vacuum gas oil, and unreacted hydrogen. The vapor phase (44) from the interstage separator is combined with a portion of the VGO feed drum stream (28*a*) and sent to a first distillate ebullated-bed reactor (30) for conversion and treatment of the diesel and vacuum gas oils.

The liquid phase (48) from the interstage separator (44) is sent to a second residue ebullated-bed unit (50) for further vacuum residue hydroconversion. The effluent from the second vacuum hydroconversion ebullated-bed reactor (54) is then sent to a hot, high pressure separator (56).

The overhead stream (60) from the hot-high pressure separator (56) contains product diesel, some VGO, and additional unreacted hydrogen, which are thereafter combined with a portion of the VGO drum feed stream (28*b*) and sent to a second distillate ebullated-bed reactor unit (32) for further hydrogenation of the diesel and hydrogenation and hydrocracking of the vacuum gas oils. It should be noted that additional recycle or make-up hydrogen (64, 65) can also be added to the first (30) and second distillate ebullated-bed reactor (32).

This second distillate ebullated-bed reactor (32) is arranged in parallel with the first distillate ebullated-bed reactor (30) which receives the overhead from the interstage separator (46) along with a portion of the VGO drum feed stream (28*a*). The product streams from the first and second distillate ebullated-bed reactors are thereafter combined and sent for product separation into naphtha, diesel and unconverted VGO.

The bottoms stream (70) from the hot, high-pressure separator (56) is thereafter sent to a product separator and fractionator (72) where it is separated into naphtha, diesel, unconverted residue stream, and a recovered VGO stream (78). The recovered VGO stream (78) is thereafter recycled back to the VGO feed drum (22) for further processing through the first (30) and second distillate ebullated-bed reactors (32).

This invention will be further described by the following example, which should not be construed as limiting the scope of the invention.

EXAMPLE 1

Vacuum residue feedstock is processed in a two-stage in series residue ebullated-bed unit. The feedrate to the plant is relatively high (>50,000 BPSD) and near the limit for a single train plant. The vacuum residue conversion system utilized in the example are residue ebullated-bed reactors. In addition to the vacuum residue feed to the residue ebullated-bed reactors, there are other VGO boiling range feedstocks (straight run, coker VGO and FCC cycle oils), which also require hydrotreatment and it is desirable to coprocess these streams in separate distillate ebullated-bed reactors along with the residue ebullated-bed overhead material which contains product diesel and vacuum gas oils. A summary of the feedstocks for this example is shown in Table 1.

This high feedrate and the need to minimize initial investment necessitated the use of interstage separation where a separation vessel between the residue ebullated-bed reactors is used to remove the gas and unreacted hydrogen from the first stage effluent. The liquid from the interstage separator is the feed to the second stage residue ebullated-bed reactor. The mixed-phase reactor product from the second stage effluent is separated in a hot high-pressure separator. The liquid from the hot high-pressure separator is the final heavy liquid product which contains full-range conversion liquids and is sent to downstream separation and fractionation.

In a pre-invention configuration, the two residue ebullated-bed reactor overhead streams would be combined and sent to additional separation steps including recovery of light liquids and preparation of recycle of the unreacted hydrogen. Alternatively, the combined overhead streams could be sent to a fixed-bed or ebullated-bed hydrotreater or hydrocracker to hydroprocess the liquids contained in the high pressure vapor plus any external or recycle distillates or VGO. However, due to the presence of a small amount of entrained vacuum residue and possible inherent or catalyst fines, this material cannot be effectively processed in a fixed-bed reactor system and an ebullated-bed reactor is most appropriate and typically specified. For high capacity situations and where significant quantities of external streams also require hydroprocessing, the flowrate of material to be processed is not possible in a single distillate ebullated-bed reactor. For this example, the $C_5^+$ liquid flowrate to the distillate ebullated-bed system was nearly 68,000 BPSD with inspections summarized in Table 2. This large feedrate cannot be adequately processed in a single distillate ebullated-bed reactor and it is necessary to utilize two reactors. Suitable hydrogenation catalysts for the ebullated-bed reactor include catalysts containing nickel, cobalt, palladium, tungsten, molybdenum and combinations thereof supported on a porous substrate such as silica, alumina, titania, or combinations thereof having a high surface to volume ratio. Typical catalytically active metals utilized are cobalt, molybdenum, nickel and tungsten; however, other metals or compounds could be selected dependent on the application.

The arrangement of the distillate ebullated-bed reactors and apportioning of feedstocks is a key element of the invention. For a typical arrangement, all of the residue feed could be processed in a two reactor stage in series configuration, preferably the whole effluent from the first reactor passing in the second reactor. For this example however and for many applications, this arrangement was found to be infeasible as a result of the large gas volume and limitations on maintaining a liquid continuous reactor system. Combining the two hot high-pressure separator overheads and then equally splitting a high pressure gas stream to a parallel ebullated-bed reactor arrangement is also not technically feasible.

The solution presented in this invention is to have a separate distillate ebullated-bed reactor for each overhead material from the residue ebullated-bed conversion unit. The low-pressure external and recycle liquid feeds are combined in a gasoil drum and with two separate pumps, and fed to the two parallel distillate ebullated-bed reactors, and, in an advantageous mode typically equally fed. Since the interstage and hot high-pressure separator overheads comprise only a small portion of the total liquid reactor feeds, the operating conditions and process performance in each reactor are advantageously nearly identical for attaining the same product quality. An advantage of the invention is to allow lower temperatures in the distillate ebullated bed reactors than in the residue ebullated-bed reactors due to gasoil feed, which result both in better conversion of the gaseous distillates from the residue ebullated-bed reactors and in a less expensive overall process. The overall liquid and gas products are combined and sent to final product separation and fractionation. The combined yields and product qualities from the distillate ebullated-bed unit are shown in Table 3.

The invention may be applied to a wide range of atmospheric/vacuum residue conversion applications including ebullated-bed reactor systems with feed streams including petroleum atmospheric or vacuum residua, coal, lignite, hydrocarbon waste streams, or combinations there of.

TABLE 1

Summary of Distillate Ebullated-Bed and Residue Ebullated-Bed Feedstocks

| Feed | SR[1] Vacuum Residue | SR VGO | Coker Derived VGO | FCC[2] HCO | FCC HLCO[3] |
|---|---|---|---|---|---|
| Rate, BPSD | 50,120 | 37,500 | 6,515 | 3,200 | 4,400 |
| Gravity, °API | 3.6 | 13.5 | 13.3 | 5.3 | 11.9 |
| Sulfur, W % | 5.96 | 3.51 | 1.7 | 1.02 | 0.71 |
| Nitrogen, W % | 0.62 | 1.63 | 0.26 | 0.11 | 0.04 |
| TBP Distillation, V % | | | | | |
| $C_5$-350° F. | | | | | |
| 350-650° F. | | | | 24.5 | 81.3 |
| 650-975° F. | 4.6 | 100.0 | 100.0 | 75.5 | 18.7 |
| 975° F.+ | 95.4 | | | | |

[1]Straight Run
[2]FCC HCO = Fluid Catalytic Cracker Heavy Cycle Oil
[3]FCC HLCO = Fluid Catalytic Cracker Heavy Light Cycle Oil

TABLE 2

Liquid Feeds to Distillate Ebullated-Bed Unit

| Feed | Stage 1 Residue Ebullated Bed Ovhd $C_5^{\pm}$ | Stage 2 H-Oil Ovhd $C_5^{\pm}$ | Recycled H-Oil VGO | SR VGO | Coker VGO | VGO Portion of FCC HLCO | Total |
|---|---|---|---|---|---|---|---|
| Rate, BPSD | 4,650 | 4,902 | 13,499 | 37,500 | 6,515 | 823 | 67,889 |
| Gravity, °API | 43.2 | 42.7 | 18.8 | 13.5 | 13.3 | 7.3 | 18.0 |
| Sulfur, W % | 0.25 | 0.25 | 0.67 | 3.51 | 1.7 | 1.13 | 2.35 |
| Nitrogen, W % | 0.13 | 0.13 | 0.35 | 1.63 | 0.26 | 0.07 | 0.20 |
| TBP Distillation, V % | | | | | | | |
| $C_5$-350° F. | 36.9 | 35.1 | | | | | 4.3 |
| 350-650° F. | 50.7 | 52.8 | | | | | 6.3 |
| 650-975° F. | 12.4 | 12.1 | 100.0 | 100.0 | 100.0 | 100.0 | 89.4 |

TABLE 3

Net Distillate Ebullated-Bed Reactor Yields and Product Qualities

| Yields | W % | V % | Process Performance | |
|---|---|---|---|---|
| $H_2S$ | 2.42 | | 650° F.$^+$ CONVERSION, W % | 44.7 |
| $NH_3$ | 0.20 | | Desulfurization, W % | 97.2 |
| $H_2O$ | 0.23 | | Nitrogen Removal, W % | 79.3 |
| $C_1$ | 0.68 | | Hydrogen Cons., SCF/BBL | 1,110 |
| $C_2$ | 0.64 | | Capacity, BPSD ($C_5^+$) | 67,900 |
| $C_3$ | 0.84 | | Number of Reactors | 2 |
| $C_4$ | 0.68 | 1.10 | Feed Gravity, °API | 18.0 |
| $C_5$-350° F. | 14.68 | 19.18 | Feed Sulfur, W % | 2.35 |
| 350-650° F. | 31.95 | 35.21 | Feed Nitrogen, W % | 0.20 |
| 650-975° F. | 49.46 | 51.56 | | |
| Total | 101.78 | 107.05 | | |

| Product Qualities | Gravity °API | S, WPPM | N, WPPM |
|---|---|---|---|
| $C_5$-350° F. | 63.9 | 200 | 70 |
| 350-650° F. | 33.2 | 330 | 120 |
| 650-975° F. | 24.3 | 1,100 | 760 |

The invention described herein has been disclosed in terms of specific embodiments and applications. However, these details are not meant to be limiting and other embodiments, in light of this teaching, would be obvious to persons skilled in the art. Accordingly, it is to be understood that the drawings and descriptions are illustrative of the principles of the invention, and should not be construed to limit the scope thereof.

We claim:

1. A process for the treatment of heavy hydrocarbon feedstream(s) containing vacuum residue comprising:

a) passing said hydrocarbon feedstream into a first residue hydroconversion reaction stage ebullated-bed reactor to hydrocrack the vacuum residue and provide an effluent, said hydrocarbon feedstream boiling above 650° F. and having 50%-100% wt material boiling above 975° F.; and b) separating said effluent from the first reaction stage ebullated-bed reactor in an interstage separator, where said effluent is separated into a vapor phase and a liquid phase, said vapor phase containing primarily vacuum gas oil and diesel and said liquid phase containing primarily vacuum residue; and c) feeding the liquid phase from said interstage separator to a second residue hydroconversion reaction stage ebullated-bed reactor to further convert the vacuum residue and provide an effluent; and d) feeding the vapor phase from said interstage separator to a first downstream distillate ebullated-bed reactor to convert and treat the vacuum gas oil and diesel; and e) processing the effluent from said second residue hydroconversion reaction stage ebullated-bed reactor of step c) in a hot, high-pressure separator to provide a second liquid phase stream and a second vapor phase stream, said second vapor phase stream containing primarily vacuum gas oil and diesel and said second liquid phase stream containing the unconverted vacuum residue; and f) feeding said second vapor phase stream from said high-pressure separator to a second downstream distillate ebullated-bed reactor to convert and treat the vacuum gas oil and diesel; and g) fractionating the second liquid phase stream from said hot, high-pressure separator to produce naphtha, diesel, VGO, and unconverted residue; and h) recovering effluents from first and second downstream distillate ebullated-bed reactors.

2. The process of claim 1 wherein the hydrocarbon feedstream contains greater than 60% wt material boiling above 975° F.

3. The process of claim 1 wherein the hydrocarbon feedstream contains greater than 70% wt material boiling above 975° F.

4. The process of claim 1 wherein the hydrocarbon feedstream contains greater than 80% wt material boiling above 975° F.

5. The process of claim 1 wherein the hydrocarbon feedstream contains greater than 90% wt material boiling above 975° F.

6. The process of claim 1 wherein at least one separate source of materials boiling in the vacuum gas oil range (650-975° F.) which could contain materials boiling in the diesel range (350-650° F.) is also fed to at least one downstream distillate ebullated-bed reactor along with the vapor phase from said interstage separator or hot high-pressure separator of step f).

7. The process of claim 1 wherein the effluent from the first downstream distillate ebullated-bed reactor and the effluent from the second downstream distillate ebullated-bed are combined and thereafter sent for hydrotreatment and product separation.

8. The process of claim 1 wherein the VGO stream of step g) is thereafter recycled back to the first and/or second distillate ebullated-bed reactors.

9. The process of claim 1 wherein the overall conversion percentage of the hydrocarbon feedstream is greater than 50% wt.

10. The process of claim 1 wherein the overall conversion percentage of the hydrocarbon feedstream is greater than 80% wt.

11. The process of claim 1 wherein the overall conversion percentage of the hydrocarbon feedstream is greater than 90% wt.

12. The process of claim 1 wherein the overall conversion percentage of the hydrocarbon feedstream is greater than 95% wt.

* * * * *